United States Patent [19]

Mitter

[11] 4,103,613

[45] * Aug. 1, 1978

[54] SCREEN PRINTING MACHINE WITH INK SUPPLY RECIPROCATION

[76] Inventor: Mathias Mitter, Falkenstrasse 57, 4815 Schloss Holte, Fed. Rep. of Germany

[ * ] Notice: The portion of the term of this patent subsequent to Aug. 1, 1995, has been disclaimed.

[21] Appl. No.: 726,876

[22] Filed: Sep. 27, 1976

[30] Foreign Application Priority Data

Sep. 29, 1975 [DE] Fed. Rep. of Germany ..... 2543394

[51] Int. Cl.[2] ..... B41F 15/40

[52] U.S. Cl. ..... 101/115; 68/200; 101/119; 101/122; 118/213; 118/242

[58] Field of Search ..... 101/114, 115, 116, 119, 101/122, 127.1, 120, 128.1, 129, 172, 211, 331, 367, 416 R, 416 A; 118/213, 240, 242; 68/200

[56] References Cited

U.S. PATENT DOCUMENTS

| | | | |
|---|---|---|---|
| 2,800,075 | 7/1957 | Rose | 101/115 |
| 3,056,384 | 10/1962 | Beale et al. | 101/115 X |
| 3,294,018 | 12/1966 | Heonis | 101/115 |
| 3,589,283 | 6/1971 | Childress | 101/DIG. 13 |
| 3,886,861 | 6/1975 | Anselrode | 101/120 X |
| 3,934,502 | 1/1976 | Marino | 101/119 X |

FOREIGN PATENT DOCUMENTS

| | | | |
|---|---|---|---|
| 2,309,300 | 9/1973 | Fed. Rep. of Germany | 101/119 |
| 2,202,081 | 8/1972 | Fed. Rep. of Germany | 101/128.1 |

*Primary Examiner*—Ronald E. Suter
*Attorney, Agent, or Firm*—Michael J. Striker

[57] ABSTRACT

A screen printing machine has one or more printing stations. Each station has an endless printing screen of generally annular configuration and is supported in end bearings. A carrier extends through the space surrounded by the screen and defines a clearance with the screen. An arrangement of tubes admits printing medium through the carrier into this clearance. The clearance is subdivided into discrete chambers so that, when different-color printing media are admitted into the different chambers the printing station is capable of printing a multi-color pattern.

27 Claims, 11 Drawing Figures

Fig.7
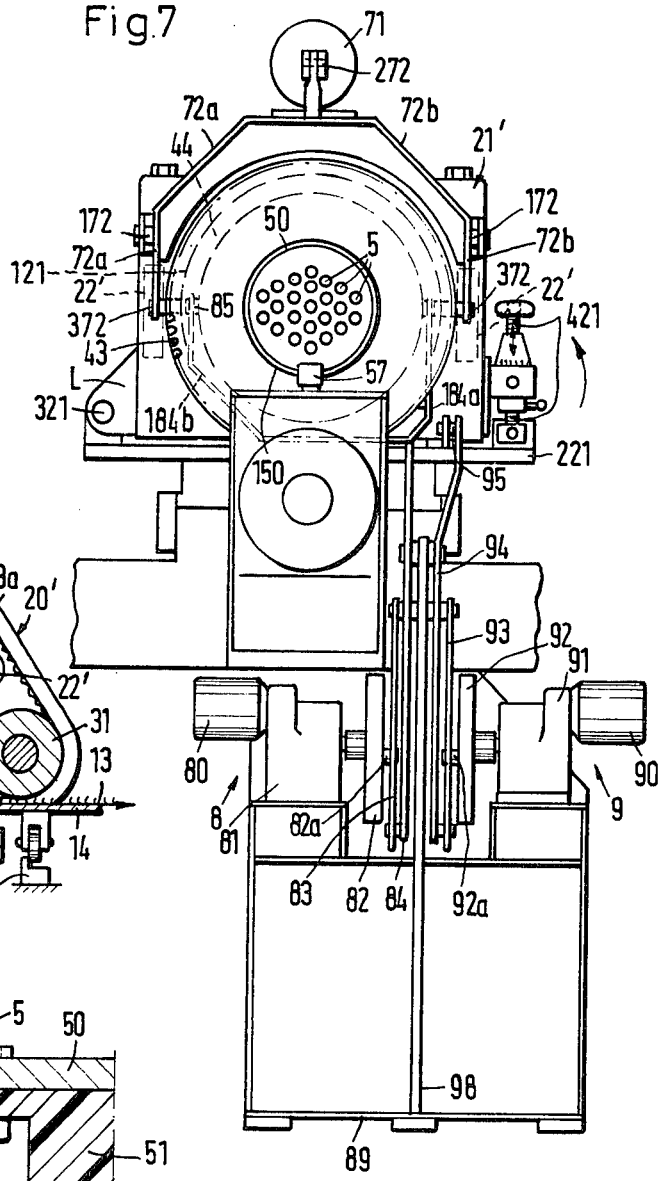
Fig.8
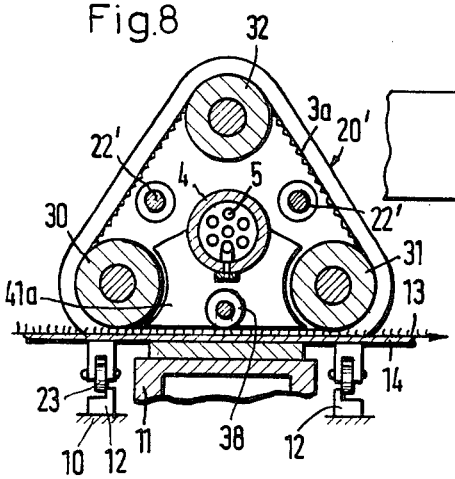
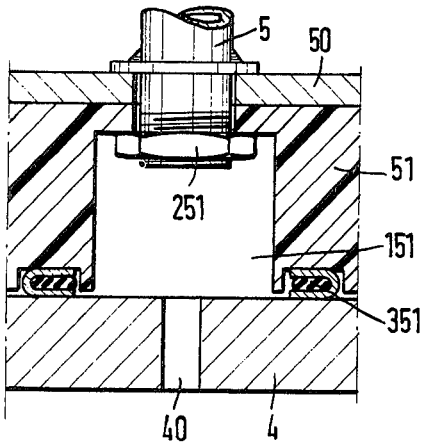
Fig.6

SCREEN PRINTING MACHINE WITH INK SUPPLY RECIPROCATION

BACKGROUND OF THE INVENTION

The present invention relates to a screen printing machine of the type having one or more printing stations each of which utilizes an endless travelling printing screen.

Screen printing machines are either of the type having a flat or planar printing screen, or of the type having an endless travelling printing screen. The latter types comes in two basic varieties, one wherein the printing screen is tubular and the other wherein the printing screen is an endless belt which is trained about a plurality of rollers, usually three rollers which are arranged at the corners of a triangle. In either case, the printing screen is of generally annular configuration.

Screen printing machines of the type having an endless travelling printing screen may be provided with one or more printing stations at each of which one of these printing screens is provided. If two or more such stations are utilized, the machine is suitable for multi-color printing. The workpiece web, such as a textile web, a carpet web or the like, is supplied beneath the printing screen, in some instances on a printing blanket which travels beneath the printing screen relative to the same and supports the web. At each printing station a printing medium, for example printing ink, ink paste or the like, is admitted into the interior of the space surrounded by the endless printing screen and is then usually squeezed by means of a squeegee or the like, through the perforations of the printing screen and onto the underlying workpiece web. The perforations of the screen which have been left permeable to the printing medium — other perforations having been made impermeable — produce the desired printing pattern.

A disadvantage of the prior-art printing machines is that the pattern is repeated again and again on the workpiece, i.e. the pattern is repeated in a constantly reoccurring uniform sequence. Furthermore, each printing station can print only a single color, so that in a machine which is intended to print, e.g. four colors, four printing stations must be provided in series, i.e. one behind the other as considered in the direction of travel of the workpiece to be printed.

SUMMARY OF THE INVENTION

It is an object of the present invention to provide an improved screen printing machine which avoids these disadvantages.

More particularly, it is an object of the invention to provide such a screen printing machine which makes it possible to vary the patterning, i.e. the application of the pattern to a workpiece web, within a very substantial range of possibilities.

A concomitant object is to provide such a machine which has one or more printing stations, each capable of effecting multi-color printing.

In keeping with these objects, and with others which will become apparent hereafter, one feature of the invention resides in a screen printing machine which, briefly stated, comprises workpiece supporting means having a surface, an endless printing screen of substantially annular configuration, the screen having an inner screen surface a portion of which is juxtaposed with the surface of the workpiece supporting means, drive means for advancing the screen in an endless path, an elongated carrier extending axially through the substantially annular printing screen and defining an annular clearance with the inner screen surface thereof, partition means provided on and extending from the carrier across the clearance to at least the portion of the screen surface and partitioning the annular clearance into at least two axial chambers, and means for admitting printing medium into each of the chambers.

The novel machine according to the present invention makes it possible, for the very first time, to make the printing screen wider than the web to be printed and to reciprocate the screen transversely of the path of advancement of the web through greater or lesser distances — which may also be continuously varied, if desired — so as to constantly offset the pattern being printed with respect to the pattern which has just been printed immediately downstream or the pattern which will be printed immediately upstream. If two or more printing stations are used, the reciprocation of all stations may be identical, or else the screens at successive stations may reciprocate in mutually opposite directions during each stroke or the reciprocation of successive printing stations may vary completely, in order to produce any tupe of desired pattern. Also for the first time, each printing station can now effect multi-color printing, since printing media of different colors may be admitted into the respective different chambers.

If the carrier is rotatable, in accordance with a further object of the invention, and if the partitions are inclined to its axis of rotation at an angle other than 90°, the position of every partition relative to the screen will constantly change (i.e. if the partitions are annular and surround the carrier for rotation therewith), so that the boundaries between the different colors being printed due to outflow of the printing media from the different chambers, keep shifting transversely on the workpiece which advances beneath the screen in direction normal to the axis of rotation of the carrier. The carrier may have a drive which is separate from that of the screen, so that the rotation of the carrier can be controlled independently of the rotation (or other advancement if a belt-type screen is involved) of the screen. This makes it possible to select the transverse boundary shift independently of the advancing speed of the screen.

The number of ink chambers (the term refers to all kinds of suitable printing media) may be two or greater than two. If more than two chambers are provided, then it is possible to print not only different-color strips side-by-side, but strips which are wavy due to the aforementioned lateral shifting. Of course, if the screen is provided with a pattern as usual, then each strip will also be patterned. If the pattern is to be sharp, and two or more successive printing stations are used, then the successive printing stations must operate synchronously. If, however, a blending-together of the prints produced by successive printing stations is desired or acceptable, i.e. a blurring of the pattern, then the successive printing stations may be operated out of synchronism.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is an enlarged-scale fragmentary sectional detail view;

FIG. 7 is a view of the machine in FIG. 1, seen in the direction of the arrow VII of FIG. 1; and FIG. 8 is a somewhat diagrammatic fragmentary cross-section through a printing station of a different type of screen printing machine;

DESCRIPTION OF THE PREFERRED EMBODIMENTS

Figure 1:
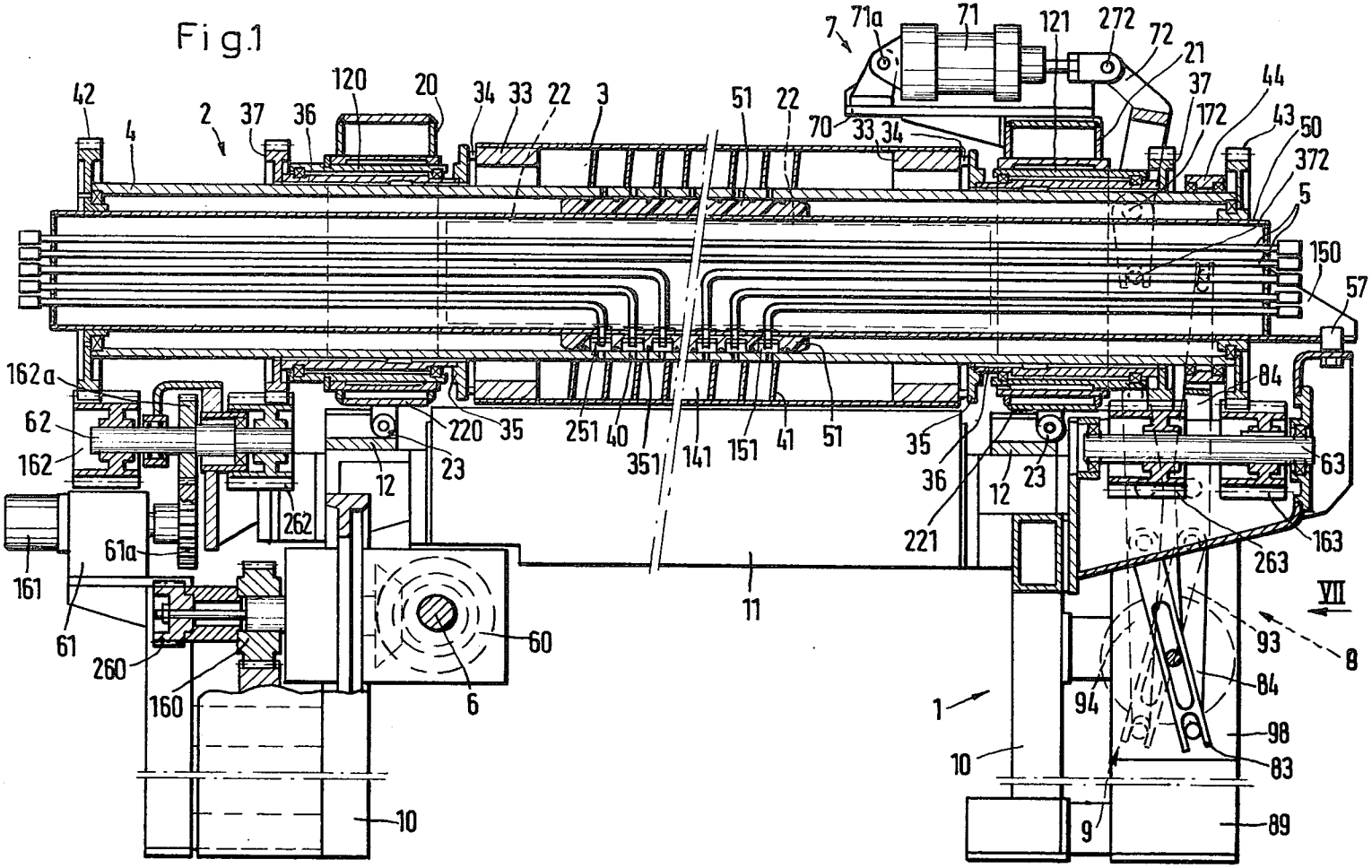
FIG. 1 is a fragmentary vertical section through a printing station of a screen printing machine embodying the invention.

Before discussing the individual embodiments in detail it should be understood that with the exception of specifically stated items, the embodiments disclosed herein utilize the same basic elements which will, therefore, be identified throughout the drawing with identical reference numerals.

Referring firstly to the embodiment in FIGS. 1, 2 and 4–7, it will be seen that the screen printing machine according to the present invention as illustrated in these embodiments has a frame 1 which is provided in the area of each printing station (only one shown) with a printing-medium applying device 2. In the region of each printing station the frame 1 is provided with upright supports 10 which are connected with one another by counter pressure beams 11. A printing blanket (not shown) may pass over the counter pressure beam 11 on top thereof, and may carry on its upper surface the workpiece web to be printed. It is emphasized that the printing blanket and workpiece web are shown only in the embodiment of FIG. 8 where they are identified with reference numerals 14 and 13, respectively. However, their presence is equally applicable to all of the other embodiments.

Mounted above the counter pressure beam 11 at the respective printing station is a printing screen 3 which in the first embodiment is of a tubular type, i.e. it is endless and of tubular shape. Mounted on the upright supports 10 are two end bearing units 20 and 21, respectively. The unit 20 is associated with the lefthand end of the tubular printing screen 3 and the unit 21 with the right-hand end thereof. The units 20 and 21 serve to mount the printing screen 3 for rotation about a generally horizontal axis. For this purpose the opposite axial ends of the tubular printing screen 3 have set into them and secured to them respective end rings 33 which are connected via connecting pins 34 with annular support plates 35 which in turn are rigidly connected with bearing sleeves 36. These are rotatably received in journalling sleeves 120 and 121, of which the sleeve 120 is mounted in the end bearing unit 20 and the sleeve 121 is mounted in the end bearing unit 21. The axially outer ends of the sleeves 36 are provided with gears 37 by means of which the printing screen 3 is to be driven in rotation, as will be discussed subsequently. The screen 3 is driven at both of its axial ends in the illustrated embodiment; however it should be understood that if it is desired — for example if the screen 3 is sufficiently strongly tensioned in axial direction thereof so as to be able to withstand the twisting forces resulting from the application of driving torque at only one end it can be driven at only one of its axial ends.

The embodiment of FIGS. 1, 2 and 5–7 shows a drive for rotating the printing screen 3. This drive comprises a main machine drive shaft 6 which may extend the length of a machine having a plurality of printing stations, and which is associated at each printing station (illustrated by way of example for the one shown in FIG. 1) with an angle drive 60. The main drive shaft 6 is rotated in any conventional manner by an appropriate prime mover and transmits rotation to the angle drive 60 which in turn rotates gears 160 and 260. The gear 260 transmits motion to a variable drive unit 61, for example to an adjustable differential drive having a control motor 161. Such drives are well known per se and are sold by "PIV" Werner Reimers KG Bad Hamburg BRD.

The drive unit 61 in turn rotates via a gear 61*a* the illustrated gear train 62 having gears 162, 162*a* and 262; the gear 262 meshes with the gear 37 at the left-hand end of the printing station so as to drive the left-hand end of the printing screen 3. The gear 162 meshes with a gear 42 which is mounted on the left-hand end of a tubular carrier 4 but extends through the end bearing units 20, 21 and through the screen 3, defining an annular clearance with the latter. The carrier 4, which will be described subsequently in more detail, serves the purpose — insofar as motion transmission is concerned — of transmitting motion to the right-hand end of the printing screen 3 so as to drive the screen at the right-hand end also, in addition to the drive applied to it at the left-hand end. For this purpose the right-hand end of the carrier 4 is provided with a gear 43 which meshes with a gear train 63 having gears 163 and 263 which are mounted on a common shaft. Gear 263 rotates the gear 37 at the right-hand end of the tubular printing screen 3 so that when the gear 263 is driven in rotation by transmittion of motion from gear 43 to gear 163, it in turn rotates the gear 37 and thus transmits motion to the right-hand end of the printing screen 3.

The application of torque to both axial ends of the printing screen 3 is advisable, but must be as identical as possible at both ends, since the printing screen 3 is essentially a rather delicate structure composed of extremely thin stainless steel foil or the like, and would become damaged if differential torque were to be applied to its opposite axial ends. The speed of rotation of the screen 3 may, incidentally, be varied by replacing appropriate gears so as to change the gear ratios.

The end bearing units 20 and 21 are connected with one another by traverse members 22 of which two or more are provided, so as to form a rigid unit. The end bearing units 20 and 21 have base plates 220 and 221, respectively, which are provided with rollers, wheels, glides or the like 23 that engage in and move along rail sections 12 provided on the uprights 10. Thus, the rigid unit composed of the end bearing units 20, 21 and the traverse members 22 can reciprocate in the axial direction of the screen 3, i.e. transversely of the path of movement of the workpiece web to be printed, which path of movement is normal to the plane of FIG. 1. It will be noted that the axial length of the gears 162, 163, 262 and 263 is substantially greater than the axial length of the gears 42, 43, 37 with which they mesh; this is to assure that despite axial reciprocation of the aforementioned unit, these gears will remain in mesh throughout. It should be noted, however, that the device for supplying and applying printing medium need not be constructed in the manner illustrated and to be described subsequently, which manner is the reason for making the gears 162 and 163 of a greater axial length than their meshing gears; it would be possible to construct the printing medium applicating device as a simple squeegee roller or the like, or a doctor-blade type of squeegee, and this would not detract from the advantages obtained by axially reciprocating the screen 3.

Figure 9:
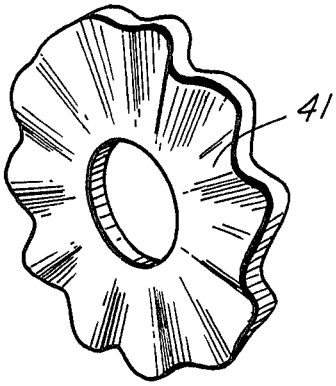
FIG. 9 is a perspective view showing an annular partition member according to one aspect of the invention.
Figure 10:
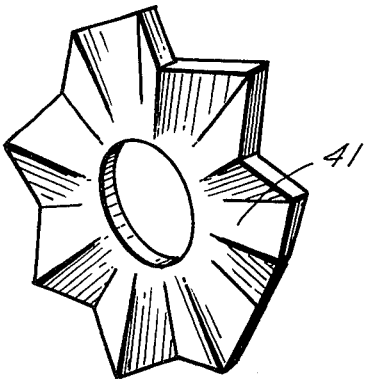
FIG. 10 is a perspective view showing an annular partition member according to another aspect of the invention.

However, the particular construction illustrated in FIGS. 1, 2 and 5–7 has particular advantages in conjunction with the axial reciprocation of the screen 3. The construction of the printing medium applicating device 2 in the illustrated embodiment is such that in the interior of the hollow carrier 4 which is driven in rotation, there is located an inner tube 50 which extends through the carrier 4 and defines with the same an annular space. The carrier 4 carries a plurality of partitions 41 which extend across the clearance defined between the carrier 4 and the interior surface of the printing screen 3 and form in this clearance at least two — as illustrated, however, a plurality — of printing medium chambers 141 into which printing medium is admitted. The partitions 41 are, in the illustrated embodiment, in form of annular members which surround the carrier 4 and which may extend normal to the axis of rotation of the carrier or, as illustrated, may be inclined to this axis at an angle other than 90°, i.e. greater or lesser. Members 41 may be planar or corrugated; if corrugated, the corrugations may be round (FIGS. 5*a* and 9) or angled. At least in the downwardly facing portion of the annular clearance between carrier 4 and screen 3, the edges of the partitions 41 must be shaped in conformance with the inner surface of screen 3 to be able to perform the desired partitioning function and to prevent printing medium in one chamber from entering the other chamber. The members 41 are not load-bearing at all and serve only as partitions.

Figure 5:
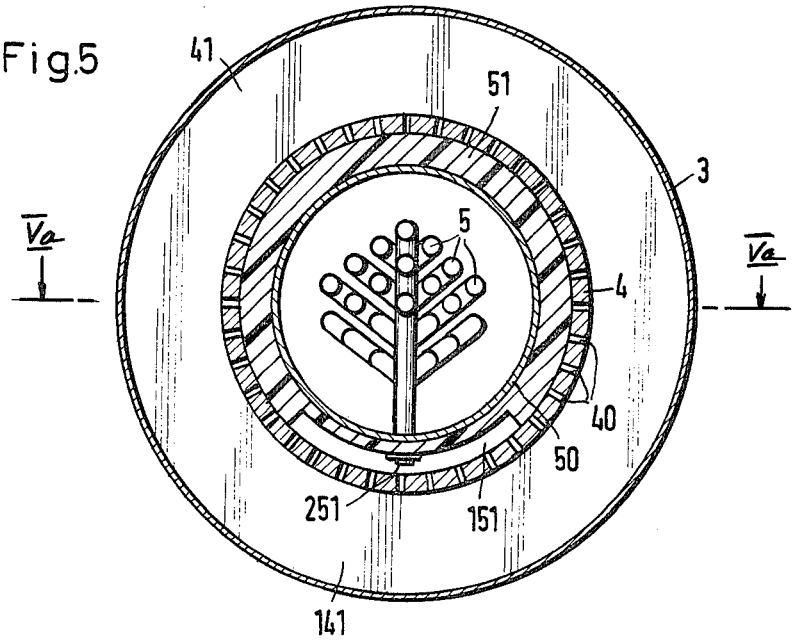
FIG. 5 is a section taken on line V—V of FIG. 4.
Figure 5A:
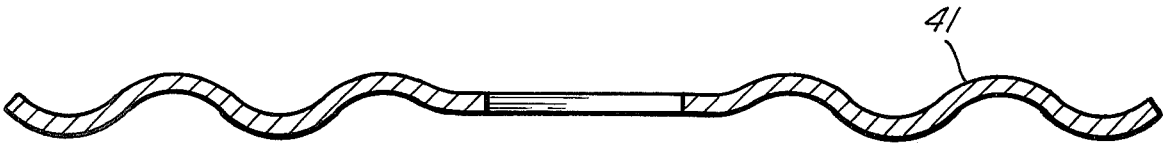
FIG. 5*a* is a section taken on line Va—Va at FIG. 5.

A plurality of printing medium tubes 5 extends into the interior of the inner tube 50 through the opposite axial ends thereof and the free ends of these tubes 5 extend through the wall of the inner tube 50 and into chambers 151 which are formed in the circumferential wall of a spacing sleeve 51 which is preferably of synthetic plastic material — e.g. PVC, polyethylene or the like — with each of which one of the tubes 5 communicates and wherein the free end of the respective tube is secured by means of a nut 251. Each of the compartments or chambers 151 in turn communicates with an opening 40 formed in the circumferential wall of the tubular carrier 4 which opening in turn communicates with a respective one of the chambers 141. Different-colored printing media may be applied into each of the chambers 141. The openings 40 are arranged in rows spaced about the periphery of carrier 4, as shown in FIG. 5. If carrier 4 is non-rotatable, a single row at the lower side thereof suffices. axially tensioning the printing screen 3. This tensioning device 7 is mounted on one of the end bearing units; in the illustrated embodiment this is end bearing unit 21 which carries a console 70 on which a fluid-operated cylinder-and-piston unit 71 is pivotally mounted at 71*a*. The piston rod of the unit 71 is articulated at 272 to a double-armed lever 72 which has two end portions 72*a* and 72*b* and is thus of fork-like configuration (compare FIG. 7). The lever 72 is pivoted on a pivot 172 secured in the unit 21 and each of the end portions 72*a* and 72*b* is slotted and engages in the respective slot a pin 372 (see FIG. 7), which pins are mounted diametrically opposite one another on the sleeve 121. Unlike the sleeve 120 at the left-hand side of FIG. 1, the sleeve 121 is axially shiftable. The gear 37 and the gear 263 are so constructed in their relative transmission ratio, that the necessary tensioning movement of the screen 3 can be obtained without any difficulty by operation of the cylinder-and-piston unit 71.

Figure 2:
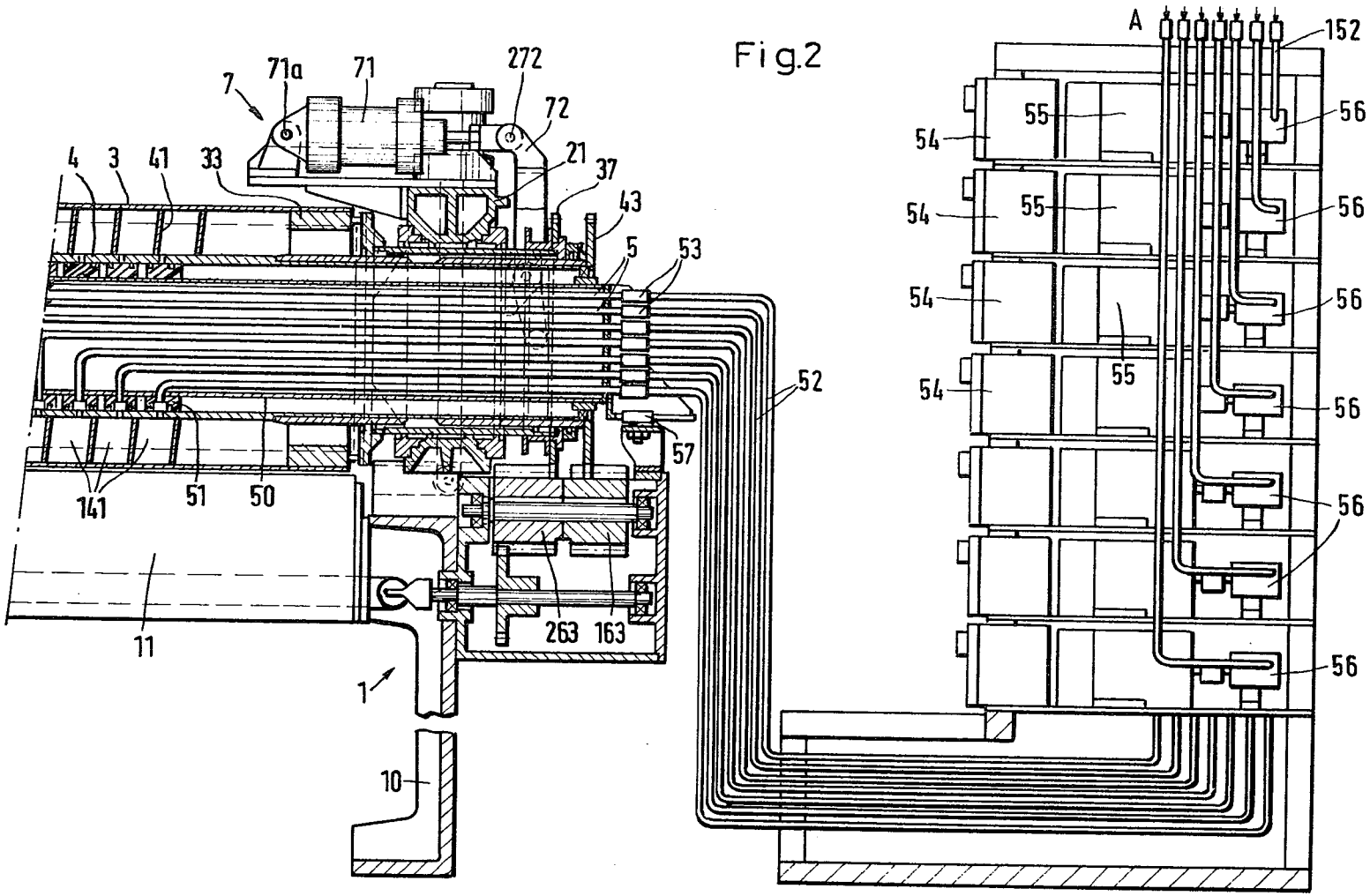
FIG. 2 is a fragmentary vertical section similar to FIG. 1, but illustrating the supply for the printing medium.

FIG. 2 shows that the axially outer ends of the printing-medium tubes 5 (only those at the right-hand end of the machine are shown in FIG. 2) communicate with flexible supply conduits 52 — e.g. hoses or the like — with which they are connected by means of quick-release couplings 53 which are known per se and are sold for ex. under the trademark "Nito" by Schlaufer Subh Bad Liebenzell, BRD. The purpose of making the conduits 52 flexible is to permit them to move to-and-fro when the entire unit composed of the end bearing units 20, 21, the screen 3 and the traverse members 22, reciprocates from left to right and vice versa.

The conduits 52 extend to a printing-medium supply unit which comprises for each of the conduits 52 a flow regulator 54 of known construction with a C.C. motor driving the pump, the C.C. motor being sold for ex. by Reliance, Rochester, N.Y. USA which is associated with a respective DC motor that drives in turn a respective pump 56 for printing medium. The suction intakes 152 of the pumps 56 communicate with printing-medium supply containers (not illustrated) from which they draw the printing medium in the direction of the arrows A.

Thus, each of the medium chambers 141 defined between two axially consecutive ones of the partitions 41 receives from an associated pump 56 a precisely predetermined — and adjustable — quantity of printing ink, printing paste or other printing medium. Additional control devices acting upon the flow regulators 54, may also be provided and are known. Of course, the inner tube 50 does not rotate, although it reciprocates with the arrangement as described before. To prevent the inner tube 50 from rotating it is formed at one of its axial ends, i.e. in the illustrated embodiment at the righthand axial end, with an extension or projection 150 that may be formed with an axial slot (not shown) into which there extends an anti-rotation member 57 that is mounted on a part of the machine frame 1.

Figure 3:
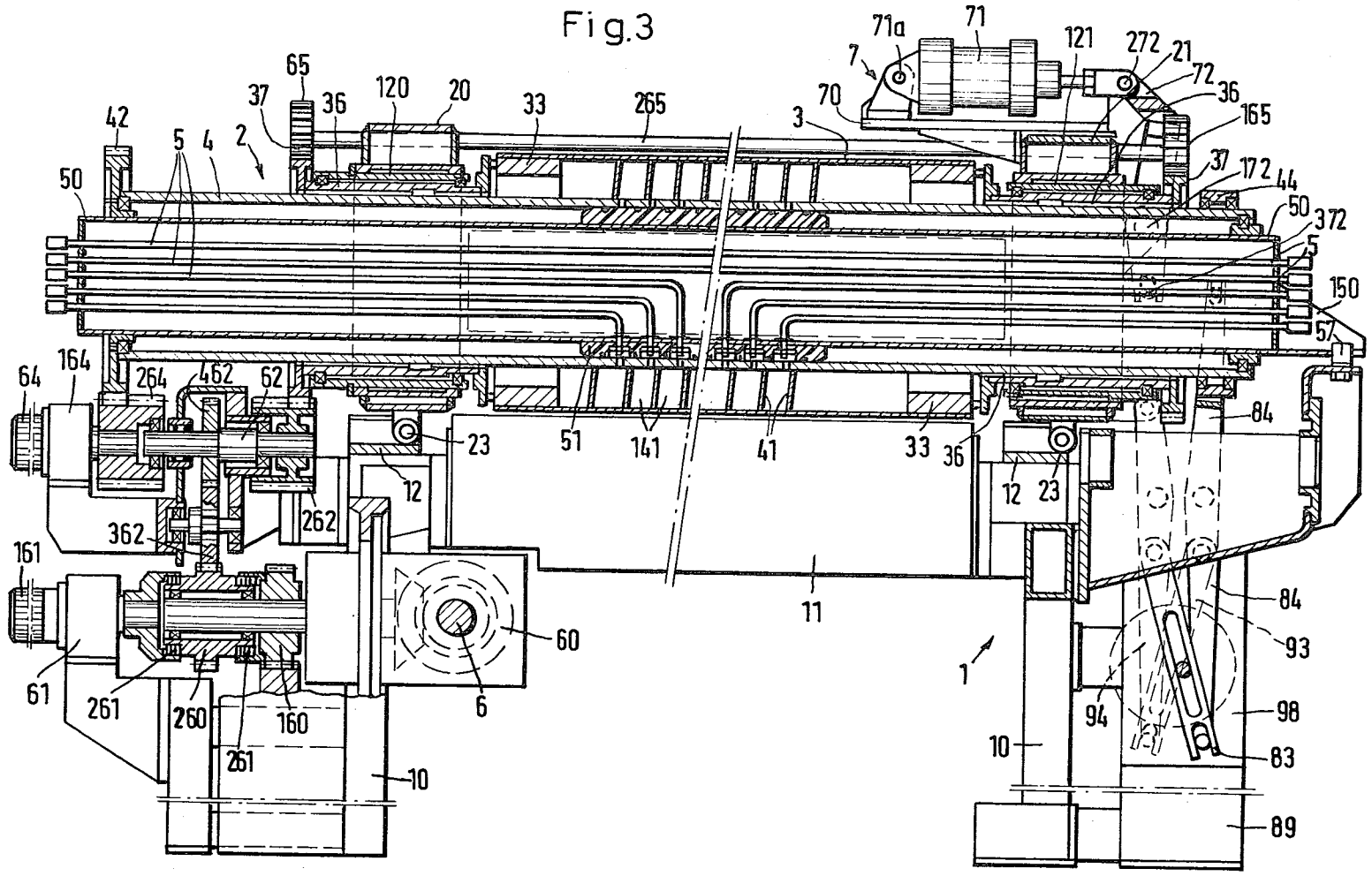
FIG. 3 is a view similar to FIG. 1 but of a further embodiment of the invention.

The embodiment in FIG. 3, which in other ways corresponds to the one in FIG. 1, is provided with a separate drive for the carrier 4. This separate drive comprises a motor 64 which drives a variable gear drive 164 such as a differential gear for example as sold by "PIV" W. Reimers KS Bad Hamburg BRD, which in turn rotates a gear 264 that meshes with the gear 42. The opposite axial end of the carrier 4 is rotatably journalled within the sleeve 36. In this embodiment, as in the preceding one, the printing screen 3 is again driven from the main drive shaft 6 via the angle drive 60 and the gears 160 and 260. The gear 260 drives via gears 362 and 462 the gear 262 which in turn meshes with the drive gear 37 for the printing screen 3. Torque is transmitted to the right-hand end of the printing screen 3, i.e. the end remote from the end at which the main drive is located which is supplied via the main drive shaft 6, by means of gears 65 and 165 which mesh with the gears 37 at the opposite axial ends of the printing screen 3 and which are coupled for joint rotation by a shaft 265. Thus, when the gear 65 is rotated by its associated gears 37, it turns the shaft 265 which in turn rotates the gear 165 that transmits rotation to the right-hand end gear 37 and thus supplies torque to the right-hand end of the printing screen 3.

Due to the presence of the two motors 64 and 161 the rotational speeds of the carrier 4 and the printing screen 3 can be freely selected at will, each independently of the other. By means of a transfer clutch 261 as sold for example by Stromag Subh, Unna, BRD the drive of the printing screen 3 can selectively be made proportional to the speed of movement of the workpiece web (not shown) or by means of the transmission 61 it can be made independent of any other factor.

Figure 4:
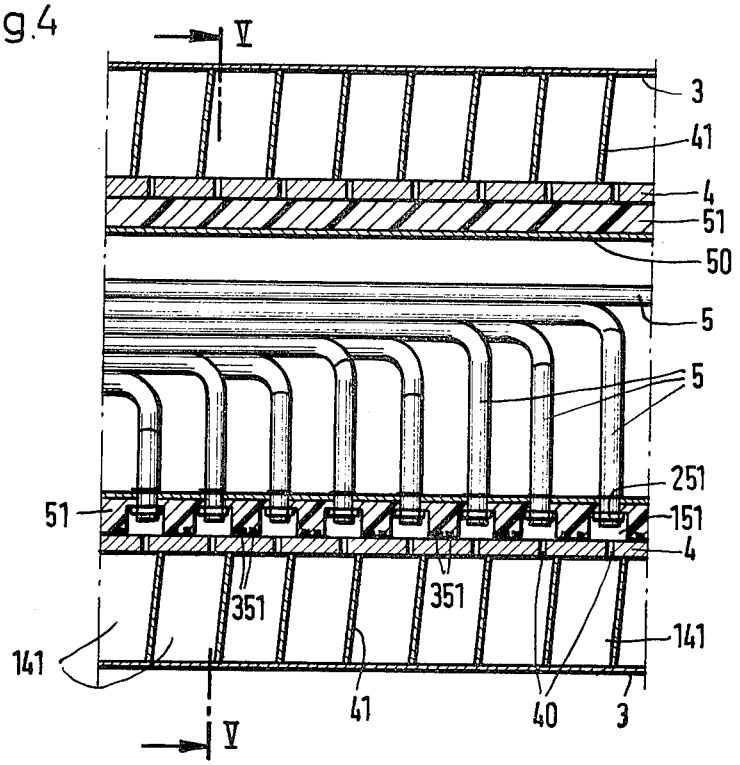
FIG. 4 is a fragmentary vertical section through a printing screen and associated components of the machine according to the present invention.

FIGS. 4, 5 and 6, which have already been mentioned earlier, illustrate one example of the supply of printing medium. As shown in these three Figures in more detail, the inner free ends of the tubes 5 extend through openings in the wall of the inner tube 50 — which reciprocates with the carrier 4 — into chambers 151 formed in the circumferential wall of the (preferably synthetic plastic) spacing sleeve 51 where they are secured by means of nuts 251. The chambers 151 are separated from one another in axial direction by means of sealing rings or strips 351 — rings or strips may be used as desired and need not extend completely about the circumference of sleeve 51 — and these chambers 151 discharge the printing medium through openings 40 in the circumferential wall of the carrier 4 into the chambers 141 defined between the successive partitions 41.

The axial reciprocation is effected in all of the embodiments in the manner shown in FIG. 7, namely by means of two crank drives 8 and 9. The crank drive 9 effects axial reciprocation of the printing screen 3 so that the latter performs an oscillating movement. For this purpose it reciprocates the complete unit composed of the end bearing units 20, 21 which are rigidly connected by the traverse members 22 and which unit moves on the wheels or the like 23 that travel on the rail sections 12. Depending upon the particular stroke being performed by the crank drive 9, this entire unit or carriages moves to the left and to the right, alternately. As illustrated, the crank drive 9 has a motor 90, a continuously variable gear drive 91 which is driven by the motor 90 and which in turn rotates an eccentric disc 92 the eccentricity of which is variable by moving an eccentric pin 92*a* in a radial elongated hole in disc 92 and clamping the pin in the desired position to vary the stroke, and two swing arms 93 and 94. The swing arm 94 is pivoted to the plate 221 of the end bearing unit 21 via a bolt 95. Opposite the crank drive 9 for the screen 3 there is located a crank drive 8 for effecting a similar reciprocation of the carrier 4. The crank drive 8 also has a motor 80, a continuously variable gear drive 81 which is driven by the motor 80 and in turn drives an eccentric disc 82 the eccentricity of which can be varied, and two swing arms 83 and 84 which are connected with one another. The upper end of the swing arm 84 is bifurcated and forms the arms 184*a* and 184*b*. These arms are connected via bolts or pins 85 with a ring 44 (compare FIG. 1) which surrounds the carrier 4, anti-friction bearings (not shown) being interposed between the carrier 4 and the ring 44. Both of the crank drives 8 and 9 are mounted on upright support 98 which in turn is secured centrally on a plate 89. Both crank drives can be adjusted as to the frequency and length of their strokes, and these adjustments can be carried out independently of the respective other crank drive so that an individually adjustable (both as to length and frequency of strokes) reciprocation can be obtained for the screen 3 as well as for the carrier 4.

This means that if desired the screen 3 may be reciprocated alone, the carrier 4 may be reciprocated alone, or both the screen and the carrier may be reciprocated jointly. Also, they may be reciprocated in one and the same direction, in mutually opposite directions, or at different frequencies and different stroke lengths so as to overlap in their reciprocation. The adjustment in the length of stroke and of frequency of stroke can be carried out from zero to the maximum for each of the crank drives 8 and 9 individually by adjusting the eccentric radius of the eccentric discs 82 and 92, the adjusting being done by moving the eccentric pins 82*a* and 92*a* in the radial elongated holes of the discs and clamping the pins in the desired positions, respectively. It is evident, of course, that if it is only desired to be able to reciprocate the screen 3, the crank drive 8 can be omitted.

To be able to effect reciprocation of the screen 3 without undue friction between the screen 3 and the workpiece, and to avoid smearing and other disadvantageous consequences, the units 20 and 21 may be tiltably mounted. This is shown for the equivalent unit 21′ in FIG. 7, where the unit 21′ will be seen to have a lug L at which it is secured to its base plate 221 for pivoting about a substantially horizontal pivot 321 at one lateral side of the printing screen 3. At the oppposite lateral side there is provided a screw-spindle unit 42′, screwable in a lug secured to the unit 21′, and reacting against the plate 221, thus being able to lift the unit 21′ and the screen 3 upwardly of the plane of movement — and hence the upper surface of — the workpiece to a desired degree. The unit 20′ is of course similarly mounted and provided.

FIG. 8 shows a further embodiment of the invention which illustrates that the invention can also be employed in a screen printing machine of the type having an endless belt-type screen 3*a* which is trained about three screen supporting rollers 30, 31 and 32 arranged at the corners of an imaginary triangle. In this embodiment it will be the opposite axial ends of the rollers 30, 31 and 32 which are journalled in the end bearing units 21″ and 21″ which are again connected by traverse members 22′ to form a rigid unit and which are again movable on the rail sections 12 by means of the wheels or the like 23. The counter pressure beam 11 is present as before, and a printing blanket 14 travels above the counter pressure beam 11 and beneath the lower printing run of the screen 3*a*, the workpiece 13 travelling in the direction of the arrow intermediate the advancing printing blanket 14 (which also travels in the direction of the workpiece) and the printing screen 3*a*. A roller squeegee 38 of known construction may be employed which is located within the confines of the screen 3*a* and squeezes printing medium through the same.

In FIG. 8 only the end bearing unit 21″ is diagrammatically illustrated; the unit 21″ is not visible. The units 20″ and 21″ may be again mounted for pivoting about horizontal pivots 321, by means of the spindles 421 as described with reference to FIG. 7. In this embodiment the axially spaced partitions 41*a* (only one shown) are simply planar partition walls which do not rotate as in the preceding embodiments but which are so shaped as to conform to the inner surface of the printing screen 3*a* at the lower printing run thereof — i.e. where it is juxtaposed with the workpiece 13 — and to the outer circumferential surfaces of the rollers 30, 31 and of the carrier 4. The entire unit can be axially reciprocated, but the carrier 4 does not rotate.

It will be appreciated that the invention is susceptible of many modifications without departing in any way from the intent and scope of the invention. What is important is the possibility of axially reciprocating the screen 3 during the printing operation, and the fact that there is in effect produced a "carriage" by rigidly connecting the end bearing units with one another via the traverse members 22 so that the unit can be reciprocated in toto. Other ways of effecting the reciprocation can be employed, for example cams can be used, or other devices. The possibility of pivoting the end bearing units about the pivots 321, and hence raising the screen 3 with reference to the working plane, is important. This makes it possible to adjust the contact — and pressure — between the screen and the workpiece very precisely and to so select it that during the reciprocation of the screen no smearing of the printed pattern on the workpiece will develop.

It will be understood that each of the elements described above, or two or more together, may also find a useful application in other types of constructions differing from the types described above.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can be applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a screen printing machine, a combination comprising workpiece supporting means having a surface; an endless printing screen of substantially annular configuration, said screen having an inner screen surface a portion of which is juxtaposed with said surface of said workpiece supporting means; drive means for advancing said screen in an endless path; an elongated carrier extending axially through said substantially annular printing screen and defining an annular clearance with said inner screen surface thereof; partition means provided on and extending from said carrier across said clearance to at least said portion of said screen surface and partitioning said annular clearance into at least two axial chambers; means for admitting printing medium into each of said chambers; and means for displacing said carrier and partition means in said annular clearance relative to said screen in at least one of the axial and circumferential directions of said annular clearance.

2. A combination as defined in claim 1, wherein said carrier is hollow and has a circumferential wall provided with at least two openings each communicating with one of said chambers; said admitting means comprising conduits communicating with the respective openings.

3. A combination as defined in claim 1, wherein said partition means comprises at least one partition having an edge portion adjacent to and contoured in mating correspondence with, said portion of said inner screen surface.

4. A combination as defined in claim 1, wherein said carrier is a tube.

5. A combination as defined in claim 4, said substantially annular screen having opposite side portions located at the ends of the annulus formed by said screen; wherein said tube has spaced axial end portions each projecting axially beyond one of said side portions; and said displacing means comprising mounting means rotatably mounting said axial end portions.

6. A combination as defined in claim 5; said displacing means comprising rotating means for rotating said tube.

7. A combination as defined in claim 5; said displacing means comprising rotating means for rotating said tube relative to, and independently of, said printing screen.

8. A combination as defined in claim 1, wherein said carrier is hollow; further comprising an inner tube received in said carrier; and wherein said admitting means comprises conduits extending in part within said inner tube.

9. A combination as defined in claim 1, wherein said admitting means comprises admitting conduits having first portions located within the confines of said screen, and flexible second portions located axially outwardly of the annulus formed by said screen, quickrelease coupling means for coupling each of said second portions to one of said first portions, and flow-regulating means in said second portions.

10. A combination as defined in claim 1; and further comprising means mounting said carrier for axial displacement relative to said screen.

11. A combination as defined in claim 10; said displacing means comprising means for reciprocating said carrier axially with respect to said screen.

12. A combination as defined in claim 10; said displacing means comprising adjustable reciprocating means for reciprocating said carrier axially with respect to said screen with a reciprocating stroke of continuously variable length.

13. A combination as defined in claim 1, said screen having lateral portions at the opposite axial ends of the annulus formed by said screen; said drive means transmitting motion at one of said axial ends to one of said lateral portions; and further comprising motion-transmitting means for transmitting motion from said one axial end to the other of said lateral portions at the other of said axial ends.

14. A combination as defined in claim 1, wherein said partition means comprises at least one partition member of at least partially annular shape.

15. A combination as defined in claim 14, wherein said partition member is inclined with reference to the longitudinal axis of said annular clearance.

16. A combination as defined in claim 14, wherein said partition member is of non-planar shape.

17. A combination as defined in claim 14, wherein said partition member is corrugated.

18. A combination as defined in claim 1, wherein said partition means comprises a plurality of partition members which partition said annular clearance into a plurality of said axial chambers; and wherein said carrier is hollow and provided with a plurality of circumferentially and axially spaced openings respective ones of which communicate with said axial chambers.

19. A combination as defined in claim 1, wherein said admitting means comprises a plurality of individual pumps each adapted to pump a flowable printing medium, a plurality of printing-medium pipes within said carrier, a plurality of flexible supply conduits each communicating with one of said pumps, and a plurality of quickrelease couplings each releasably coupling one of said conduits with one of said pipes.

20. In a screen printing machine, a combination comprising workpiece supporting means having a surface; an endless printing screen of substantially annular configuration, said screen having an inner screen surface a portion of which is juxtaposed with said surface of said workpiece supporting means; drive means for advancing said screen in an endless path; an elongated hollow carrier extending axially through said substantially annular printing screen and defining an annular clearance with said inner screen surface thereof; an inner tube received in said carrier and defining an annular space within the same; partition means provided on and extending from said carrier across said clearance to at least said portion of said screen surface and partitioning said annular clearance into at least two axial chambers; means for admitting printing medium into each of said chambers, including conduits extending in part within said inner tube; and a spacing sleeve received in said space and formed with at least two compartments in its circumferential wall, each of said compartments communicating with one of said chambers and with at least one of said conduits.

21. A combination as defined in claim 20; and further comprising sealing means for preventing communication of said compartments with one another.

22. In a screen printing machine, a combination comprising workpiece supporting means having a surface; an endless printing screen of substantially annular configuration, said screen having an inner screen surface a portion of which is juxtaposed with said surface of said workpiece supporting means; drive means for advancing said screen in an endless path; an elongated carrier extending axially through said substantially annular printing screen and defining an annular clearance with said inner screen surface thereof; partition means provided on and extending from said carrier across said clearance to at least said portion of said screen surface and partitioning said annular clearance into at least two axial chambers; means for admitting printing medium into each of said chambers; means mounting said carrier for axial displacement relative to said screen; and comprising adjustable reciprocating means, including a crank drive for reciprocating said carrier axially with respect to said screen with a reciprocating stroke of continuously variable length.

23. A combination as defined in claim 22, wherein said crank drive comprises swing-arms and an eccentric for controlling the magnitude of swings performed by said arms.

24. In a screen printing machine, a combination comprising workpiece supporting means having a surface; an endless printing screen of substantially annular configuration, said screen having an inner screen surface a portion of which is juxtaposed with said surface of said workpiece supporting means; drive means for advancing said screen in an endless path; an elongated carrier extending axially through said substantially annular printing screen and defining an annular clearance with said inner screen surface thereof; partition means provided on and extending from said carrier across said clearance to at least said portion of said screen surface and partitioning said annular clearance into at least two axial chambers; means for admitting printing medium into each of said chambers; and first means for rotating said carrier and second means for axially reciprocating said carrier, each of said first and second means being operable independently of the other.

25. In a screen printing machine, a combination comprising workpiece supporting means having a surface; and endless printing screen of substantially annular configuration, said screen having an inner screen surface a portion of which is juxtaposed with said surface of said workpiece supporting means, and lateral portions at the opposite axial ends of the annulus formed by said screen; an elongated carrier extending axially through said substantially annular printing screen and defining an annular clearance with said inner screen surface thereof; partition means provided on and extending from said carrier across said clearance to at least said portion of said screen surface and partitioning said annular clearance into at least two axial chambers; means for admitting printing medium into each of said chambers; drive means transmitting motion at one of said axial ends to one of said lateral portions and including a drive shaft and gear means driven by said drive shaft and transmitting motion to said screen and to said carrier at said one axial end; and motion-transmitting means for transmitting motion from said one axial end to the other of said lateral portions at the other of said axial ends, including meshing gears on said carrier and said screen at said other axial end.

26. In a screen printing machine, a combination comprising workpiece supporting means having a surface; an endless printing screen of substantially annular configuration, said screen having an inner screen surface a portion of which is juxtaposed with said surface of said workpiece supporting means; drive means for advancing said screen in an endless path; an elongated hollow carrier rotatable about its longitudinal axis and extending axially through said substantially annular printing screen and defining an annular clearance with said inner screen surface thereof; partition means provided on and extending from said carrier across said clearance to at least said portion of said screen surface and partitioning said annular clearance into at least two axial chambers; means for admitting printing medium into each of said chambers; an inner tube extending with clearance through said carrier; means for preventing rotation of said inner tube; and means for effecting reciprocation of said carrier and inner tube in direction axially of said carrier.

27. A combination as defined in claim 26, said reciprocating means comprising a swing-arm drive, and a ring surrounding a portion of said carrier and connected to the same and to said swing-arm drive so as to be reciprocated axially by said swing-arm drive and thereby to reciprocate said carrier and said inner tube.

* * * * *